United States Patent [19]

Dhondt

[11] 4,162,960

[45] Jul. 31, 1979

[54] SHALE RETORTING PROCESS AND APPARATUS

[75] Inventor: Roland O. Dhondt, Long Beach, Calif.

[73] Assignee: Union Oil Company of California, Brea, Calif.

[21] Appl. No.: 891,280

[22] Filed: Mar. 29, 1978

[51] Int. Cl.[2] ..... C10G 1/02; C10B 31/02; C10B 49/06; C10B 53/06

[52] U.S. Cl. ..... 208/11 R; 201/28; 201/29; 201/32; 201/36; 201/40; 201/42; 201/43; 202/99; 202/221; 202/262; 414/301

[58] Field of Search ..... 201/3, 4, 28, 29, 32, 201/34, 36, 40, 42, 43; 202/96, 99, 108, 121, 93, 221, 262; 208/11 R; 214/17 CB

[56] References Cited

U.S. PATENT DOCUMENTS

| | | | |
|---|---|---|---|
| 1,065,960 | 7/1913 | Murray | 214/17 CB UX |
| 2,980,592 | 4/1961 | Deering et al. | 201/32 |
| 3,004,898 | 10/1961 | Deering | 201/3 |
| 3,483,116 | 12/1969 | Hoffert | 208/11 R |
| 3,499,834 | 3/1970 | Goins | 208/11 R |
| 3,597,347 | 8/1971 | Ellington, Jr. | 208/11 R |
| 3,780,887 | 12/1973 | Bottoms | 214/17 CB |
| 4,025,416 | 5/1977 | Deering et al. | 201/32 X |

*Primary Examiner*—Joseph Scovronek
*Attorney, Agent, or Firm*—Richard C. Hartman; Dean Sandford; Cleveland R. Williams

[57] ABSTRACT

Crushed oil shale is segregated into a major portion of relatively large particles and a minor portion of "fines" which will pass through screen openings up to about ¼ inch in size. The large particles are subjected to retorting as an upflowing moving bed in countercurrent contact with downflowing hot eduction gas, while the fines are retorted by controlled distribution over the hot upper surface of the bed of retorted large particles.

12 Claims, 1 Drawing Figure

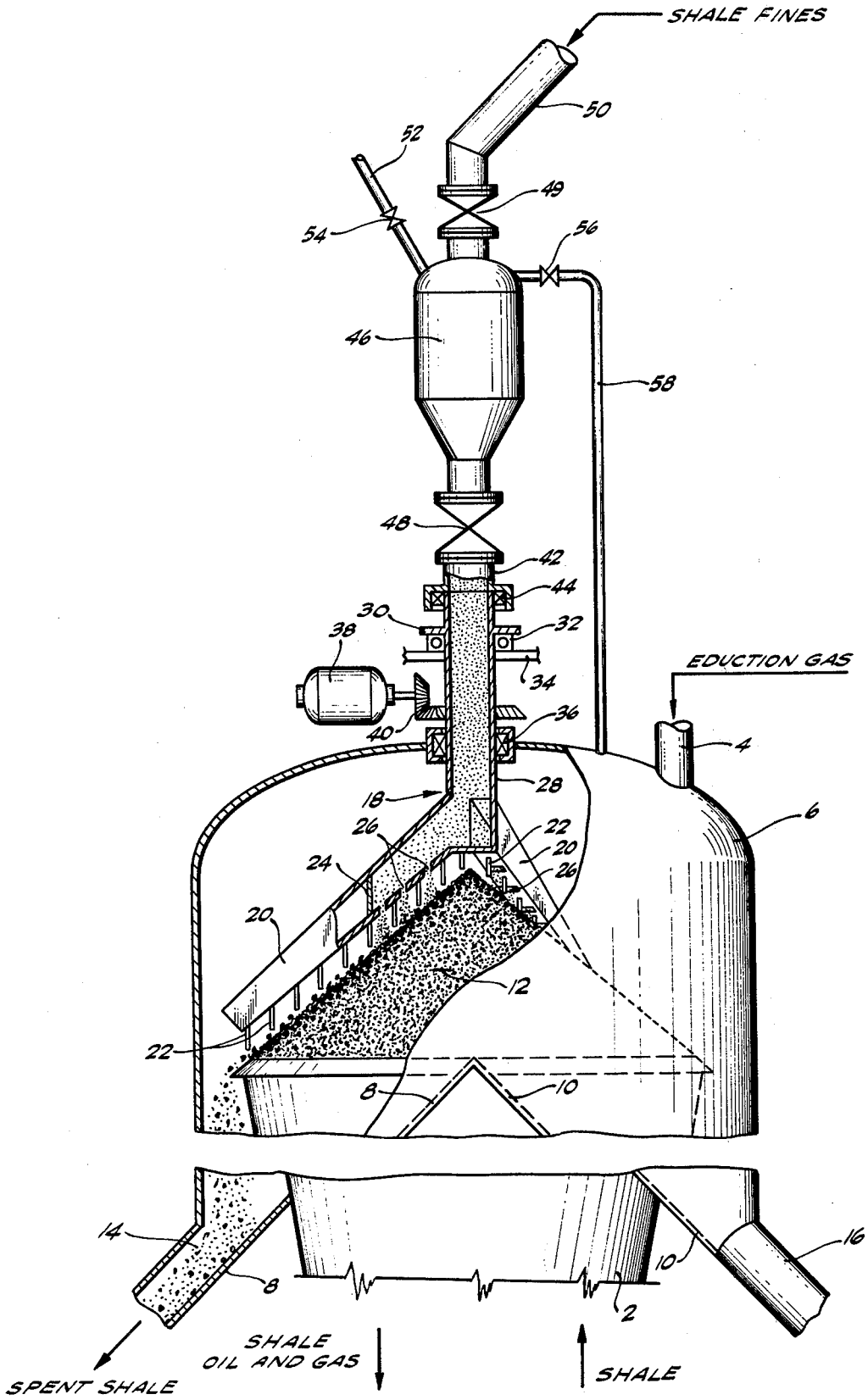
SHALE FINES
50
52
49
54
56
46
58
48
42
44
30
32
38
34
EDUCTION GAS
40
36
4
28
18
6
26
22
20
24
26
20
12
22
8
10
14
16
10
8
2
SHALE
OIL AND GAS
SHALE
SPENT SHALE

SHALE RETORTING PROCESS AND APPARATUS

BACKGROUND AND SUMMARY OF INVENTION

In the retorting of crushed oil shale with hot eduction gases, a persistent problem has been that of providing efficient retorting of shale particles varying widely in size. Commonly applied shale crushing techniques are controlled to produce a consist containing no particles larger than a permissible maximum, usually about 2–4 inches in diameter. Such crushing also inherently produces from about 2–15 wt.% of shale "fines" having a diameter of less than about ¼ inch. If this entire consist is utilized in the most prevalent of retorting methods; i.e. countercurrent flow of hot retorting gas with a compact moving bed of the shale particles, serious problems arise. Among these problems are high gas pressure drop through the bed, uneven distribution of gas flow in the bed and increased solids content in the product oil.

To avoid these problems, it has become customary in the art to screen out the fines from the retort feed, and either subject them to separate retorting, or discard them. It would obviously be economically attractive to provide some means for integrating the retorting of shale fines with the retorting of the main body of shale, if the aforementioned problems could be avoided.

It has now been found that such an integration can be achieved in a particular type of retorting in which the main body of crushed shale is pumped upwardly through a retort, countercurrent to preheated downflowing eduction gas, and spent shale above the top of the retort is allowed to form a free standing cone with an angle of repose permitting the free gravitation of spent shale from the apex of the cone downwardly and outwardly over the upper edge of the retort. According to my invention, in such retorting up to about 15 wt.%, based on total shale feed to the retort, of fines having a diameter of about ¼ inch or less can be distributed on the top surface of said cone of spent shale, at or near the apex thereof, and the resulting residence time of such fines under undisturbed gravity flow conditions is sufficient to effect substantially complete retorting thereof with no significant adverse effects on pressure drop, gas flow distribution, or solids content of the product oil which is taken off at the bottom of the retort.

PRIOR ART

U.S. Pat. No. 3,004,898 discloses a solids-upflow, gas-downflow retorting system in which raw shale fines of 0–½ inch in diameter, and amounting to about 20 wt.% of the total shale feed, are subjected to separate retorting in concurrent flow with eduction gas, while a very minor proportion of shale fines in the micron size range recovered as a concentrated sludge in the product oil is introduced onto the surface of the spent shale at the top of the retort, where the oil content of the sludge is vaporized and the remaining "micro"-fines are instantaneously retorted. A scraper at the top of the retort continuously scrapes spent shale from the retort maintaining a flat upper surface thereof, and eliminating any possibility of automatic gravity control over the distribution and residence time of shale fines. Agitation provided by the scraper also tends to increase the downward infiltration of micro-particles of spent shale to increase bed pressure drop and contaminate the product oil.

BRIEF DESCRIPTION OF DRAWING

The attached drawing is an elevation view, partly in vertical diametric cross section, of a preferred fines distribution and retorting system according to the present invention.

DETAILED DESCRIPTION

The characteristics of raw oil shales are generally well known and hence need not be described in detail. For practical purposes, however, the shale should contain at least 10, preferably at least about 20 and usually between about 25 and 75 gallons of oil per ton by Fischer assay. The shale is crushed by conventional means to produce a raw consist having no particles greater than about 4 inches, and preferably none greater than about 2½ inches in diameter. (Shale particle "diameters" herein refer to the smallest size of screen opening through which particles of the designated "diameter" will pass.) Particle size ranges for the upflow feed to the retort are as follows:

| | Particle Diameter, inches | | |
|---|---|---|---|
| | Maximum | Preferred | Minimum |
| Largest Particles | 4 | 1-1/2 to 2-1/2 | 1 |
| Smallest Particles | 1/4 | 1/10 to 3/16 | 1/16 |

Particle size ranges for the shale fines are as follows:

| | Particle Diameter, inches | | |
|---|---|---|---|
| | Maximum | Preferred | Minimum |
| Largest Particles | 1/4 | 1/10 to 3/16 | >0 |
| Smallest Particles | 1/8 | 1/10 to 1/8 | >0 |

In order to avoid undue infiltration of shale fines downwardly into the shale bed, it is further preferred that at least about 25%, and still more preferably at least about 50% by weight of the fines should be made up of particles of diameter greater than 1/16 inch.

Screening to produce the desired shale feeds is carried out in conventional fashion and the resulting recovery of 0–¼ inch fines usually amounts to about 3–15 weight % of the total, and of 0–⅛ inch fines about 2–10 weight %.

In the process of this invention, the maximum proportion of fines which can be successfully retorted without appreciable disruption of gas flow patterns, temperature profiles and pressure drop characteristics is about 15 weight %, and usually about 10 weight %, based on total feed to the retort.

In the simplest modification of the process, the shale fines can simply be dumped continuously or intermittently on or near the apex of the spent shale cone in the retort. However, this tends to increase localized pressure drop through the axial region of the shale bed, and may provide unnecessarily long residence time of fines in the retorting zone. It is usually preferable therefore to distribute the fines in a concentric circular band or bands located downward and outward radially from the cone apex, on the surface of the spent shale. Shale fines having a diameter of ⅛" or less can be completely retorted in less than about 1 minute, and such fines are hence preferably distributed in a band located substantially downward from the cone apex, toward the rim of the retort. Conversely, when the fines include particles up to ¼" in diameter, they are preferably distributed closer to the cone apex. In general, for particles ranging up to about ¼" in size, it is seldom necessary to provide a residence time of more than about 5 minutes, usually about 0.5–3 minutes.

Reference is now made to the drawing which illustrates a preferred mode of fines distribution and retorting. Retort 2 may be a conventional frusto-conical structure of the type described in U.S. Pat. No. 3,361,644, which also describes a suitable feeder mechanism at the lower end thereof for pumping the main body of crushed shale upwardly through the retort. An oxygen-free eduction gas, preheated to about 900°–1150° F., is admitted via inlet conduit 4, affixed to shroud 6, which in turn is affixed in fluid-tight fashion to the outer wall of the retort by means of bilaterally sloping floors 8 and 10, welded to the sides of the retort and the lower extremity of shroud 6.

As the shale progresses upwardly through the retort its temperature is gradually increased to eduction levels by the downflowing eduction gas, which is preferably a recycle portion of make gas from the retort, consisting mainly of $H_2$, $CH_4$, $C_2$–$C_5$ hydrocarbons and $CO_2$. Suitable flow rates for gases of this nature generally range between about 12–15 MSCF per ton of total shale feed; the total heat input for successful retorting herein ranges between about 350,000 and 450,000 BTU's per ton of shale. The total heat input is controlled, as by adjusting the temperature and/or flow rate of the eduction gas to achieve the desired yield of product gas and oil from the upflowing shale plus the shale fines. Retorting pressures (at the top of the retort) range between about 5 and 400 psig, preferably about 10–50 psig. Generally, the upflowing shale residence time in the retort is about 20 minutes to 2 hours. The educed product oil and gases flow downwardly through the shale bed and are recovered at the bottom of the retort as described in the above U.S. Pat. No. 3,361,644.

The spent shale is allowed to form a free-standing cone 12 at the top of the retort, usually defined by an angle of repose of the shale particles of about 35°–45° from horizontal. Spent shale slides by gravity down the cone surface and falls over the edge of the retort onto sloping floors 8 and 10, and is removed via outlet conduits 14 and 16, which are sealed by conventional means not shown to prevent the escape of gases therethrough.

Shale fines distribution system, indicated generally at 18, comprises one or more, preferably three, evenly spaced rotating hollow distribution arms 20, sloping radially downwardly, substantially parallel to the surface of spent shale cone 12, from a position near the apex thereof to a peripheral position located as far outwardly therefrom as delivery of shale fines may be desired. In the modification illustrated, distribution arms 20 extend substantially to the rim of the retort in order that they may perform a dual function: fines distribution and a raking action to break up any large spent shale agglomerates which may occasionally form and disrupt normal solids and gas flow. For this purpose a series of downwardly extending teeth 22 are provided, affixed to and depending from the underside of arms 20 and extending downwardly to about 2–8 inches above the normal surface of cone 12. Thus, in normal operation, teeth 22 do not contact the surface of the spent shale. Such contact is undesirable because it tends to cause crumbling of the friable spent shale and promotes the downward sweep of micro-fines by the downflowing eduction gas, resulting in increased bed pressure drop and contamination of product oil.

A solid partition 24 is affixed in each of arms 20, defining the outer extremity of desired fines distribution onto cone 12. Distribution takes place by gravity flow through orifices or slots 26 in the bottom of arms 20.

Distribution arms 20 are affixed at their inward extremity to rotating fines-delivery conduit 28, which is supported by means of flange 30 on bearings 32 and structural support elememt 34. A pressure-retaining seal at the point of entry of conduit 28 into the retorting zone is provided in the form of packing gland 36. Motive power for rotation of the entire delivery and distribution system is provided by means of motor 38 and bevel gears 40. The upper extremity of rotating conduit 28 communicates with the bottom of stationary delivery conduit 42 via pressure retaining packing gland 44. Satisfactory distribution of fines onto cone 12 using a three-arm system can usually be obtained with only about 15–60 revolutions per hour of distribution system 18.

In order to transfer shale fines from atmospheric storage to the pressurized retort system, a conventional lock vessel 46 is provided, communicating via valve 48 with stationary conduit 42, and via valve 49 with shale supply conduit 50. A gas vent line 52 controlled by valve 54 is provided to depressure vessel 46 (valve 48 closed) prior to opening valve 49 for charging the vessel with shale fines. With a fresh shale charge in place, valves 54 and 49 are closed and valve 56 in pressure equalizing conduit 58 is opened in order to equalize pressures in vessel 46 and the retorting zone. Valve 48 can then be opened to deliver the shale charge to the distribution system. It will be understood that the operation of valves 48, 49, 54 and 56 can readily be controlled by conventional automatic cycle timer means.

As an alternative to the above intermittent shale fines transfer system, lock vessel 46 and valve 48 can be replaced with a conventional star feeder adapted to provide a continuous transfer of fines from low-pressure supply conduit 50 to pressurized stationary conduit 44.

EXAMPLE

An exemplary set of operating conditions for the retorting of 10,000 tons/day of ⅛–2 inch crushed shale having a Fischer assay of 41 gallons per ton and 500 tons per day of 0–⅛ inch shale fines distributed over the cone of spent shale as illustrated in the drawing is as follows:

| | | |
|---|---|---|
| Retort pressure, psig | | 10 |
| Eduction gas temp., °F. | | 1000 |
| Eduction gas rate, SCF/ton of total shale | | 13,800 |
| Eduction gas composition, Vol.% | | |
| $H_2$ | 22.0 | |
| $CH_4$ | 21.0 | |
| $CO_2$ | 16.8 | |
| $H_2O$ | 7.4 | |
| CO | 4.6 | |
| $H_2S$ | 5.2 | |
| $C_2$—$C_5$ | 20.6 | |

Under these conditions the yield of net make gas having the same composition as the above eduction gas is about 1017 SCF per ton of shale, and the yield of total liquid product is about 298 lbs per ton of shale. This gas yield is slightly higher and the liquid yield is slightly lower than the respective yields obtained by the upflow retorting of 10,500 tons/day of ⅛–2 inch shale under the same conditions with no added fines, but overall hydrocarbon yields are approximately the same.

The following claims and their obvious equivalents are believed to define the true scope of the invention.

I claim:

1. In a shale retorting process wherein a bed of granular crushed oil shale essentially free of particles having a diameter less than about 1/16 inch and above about 4 inches is passed upwardly through a retort, countercurrently to a preheated downflowing oxygen-free eduction gas to educe product oil and gas therefrom, and wherein spent shale is allowed to overflow by gravity from the top perimeter of said retort thereby forming a free-standing cone of spent shale extending above the top of said retort through which said preheated downflowing eduction gas passes, the improved method for retorting raw crushed oil shale fines essentially free of particles having a diameter greater than about ¼ inch which comprises:

(1) distributing said raw shale fines over an upper portion of the surface of said cone of spent shale at a rate no greater than about 15 weight-percent of total raw shale, including fines, being fed to said retort, said upper portion of surface being selected so as to provide a sufficient residence time of said shale fines gravitating down the surface of said cone to the perimeter of said retort to effect retorting of said fines; and (2) controlling the flow rate and the temperature of said eduction gas so as to produce product gas and oil from said upflowing shale and said shale fines.

2. A process as defined in claim 1 wherein said crushed oil shale fines contain at least about 25 weight-percent of particles having a diameter greater than 1/16 inch.

3. A process as defined in claim 1 wherein said shale fines are distributed in step (1) over said upper portion of surface at a maximum rate of about 10% by weight of total raw shale being fed to said retort.

4. A process as defined in claim 1 wherein the average residence time of said shale fines on the surface of said cone is between about 0.5 and 5 minutes.

5. A process as defined in claim 1 wherein said bed of crushed oil shale is essentially free of particles having a diameter less than about 1/10 inch and greater than about 2½ inches.

6. A process as defined in claim 5 wherein said shale fines are essentially free of particles having a diameter above about 3/16 inch.

7. A process as defined in claim 5 wherein said shale fines contain at least about 25% by weight of particles having a diameter greater than 1/16 inch.

8. A process as defined in claim 1 wherein said shale fines are distributed in step (1) over a circular band of said cone surface located outward from the apex thereof, but substantially inward from the perimeter thereof.

9. A process as defined in claim 1 wherein the largest particles in said bed of crushed oil shale have a diameter between about 1½ and 2½ inches, the smallest particles in said bed have a diameter between about 1/10 and 3/16 inch, and wherein the largest particles in said shale fines have a diameter between about 1/10 and 3/16 inch, at least about 25% by weight of said fines being particles having a diameter greater than 1/16 inch.

10. A shale retorting apparatus comprising:

(1) a frusto-conical retort vessel adapted to receive upflowing crushed shale and to discharge spent shale over the top perimeter thereof;

(2) a fluid-tight shroud enclosing the upper portion of said retort vessel and affixed thereto by means of a sloping floor below the top perimeter of said retort vessel, said sloping floor being adapted to receive spent shale discharged from said retort vessel and to transmit the same by gravity flow to one or more spent shale discharge conduits;

(3) a shale fines delivery conduit vertically and rotatably mounted above said shroud, and extending via a fluid-tight seal through the central portion of the roof of said shroud, and terminating downwardly a substantial distance above the top center of said retort vessel;

(4) at least one hollow shale fines distribution arm rigidly affixed to the lower end of said delivery conduit communicating with the interior thereof and extending downwardly and outwardly therefrom a substantial distance, the under surface of said distribution arm being perforated over at least a portion of its length so as to permit gravity fall of shale fines therethrough at a selected position above said retort vessel;

(5) motive means for rotating said delivery conduit;

(6) pressure-sealed means communicating with the top of said delivery conduit for the gravity feed of shale fines thereto; and (7) conduit means for delivering preheated eduction gas through said shroud for passage downwardly through said retort vessel.

11. An apparatus as defined in claim 10 including a plurality of downwardly extending scraper teeth affixed to the under surface of said distribution arm, and adapted to break up large aggregates of spent shale discharging from said retort vessel.

12. An apparatus as defined in claim 10 comprising three of said hollow distribution arms spaced radially from each other at substantially 120° angles.

* * * * *